US011614303B1

(12) United States Patent
Ancona

(10) Patent No.: US 11,614,303 B1
(45) Date of Patent: Mar. 28, 2023

(54) PROTECTION SHIELD FOR HANDGUNS

(71) Applicant: TAE CONSULTORIA E ASSESSORIA EM SEGURANÇA LTDA., São Paulo (BR)

(72) Inventor: Vicente Paulo Ancona, São Paulo (BR)

(73) Assignee: TAE CONSULTORIA E ASSESSORIA EM SEGURANÇA LTDA., Sao Paulo (BR)

( * ) Notice: Subject to any disclaimer, the term of this patent is extended or adjusted under 35 U.S.C. 154(b) by 0 days.

(21) Appl. No.: 17/450,718

(22) Filed: Oct. 13, 2021

(51) Int. Cl.
*F41C 27/04* (2006.01)
*F41H 5/08* (2006.01)

(52) U.S. Cl.
CPC ..... *F41C 27/04* (2013.01); *F41H 5/08* (2013.01)

(58) Field of Classification Search
CPC ..... F41H 5/08; F41H 5/10; F41H 5/12; F41H 5/013; F41C 27/04
USPC ..... 89/36.06, 36.07
See application file for complete search history.

(56) References Cited

U.S. PATENT DOCUMENTS 3,559,528 A * 2/1971 Cunningham ..... F41A 23/34 89/40.03
7,302,880 B1 * 12/2007 Elasic ..... F41H 13/0087 89/36.01
8,800,195 B2 * 8/2014 LaFrance ..... F41G 11/003 42/114
2003/0213359 A1 * 11/2003 Kropf ..... F41H 5/14 89/36.09
2011/0056366 A1 * 3/2011 Ran ..... F41H 5/12 89/36.06
2013/0098234 A1 * 4/2013 Armellino, Jr. ..... F41H 5/08 89/926
2014/0366711 A1 * 12/2014 Woo ..... F41H 7/02 89/36.02
2014/0366712 A1 * 12/2014 Woo ..... F41H 5/14 89/36.02
2014/0366714 A1 * 12/2014 Woo ..... F41H 7/02 89/36.08
2017/0167826 A1 * 6/2017 Spransy ..... F41C 27/04
2018/0017360 A1 * 1/2018 Adamow ..... F41H 5/26
2021/0404773 A1 * 12/2021 Swain ..... F41H 5/08

FOREIGN PATENT DOCUMENTS

WO WO-2020185827 A9 * 10/2020 ..... F41A 27/10

* cited by examiner

*Primary Examiner* — John Cooper
(74) *Attorney, Agent, or Firm* — FisherBroyles, LLP; Susan M. Oiler

(57) ABSTRACT

A protection shield for handguns has a transparent or translucid shield made of ballistic material, or not, and a pass-through aperture centered therein of a big enough size so that it can be transpierced by the barrel and a portion of the gun frame. The shield includes a handgun coupling that has a block having on its upper portion a groove for receiving a gun rail and having on the lower portion a rail projecting crosswise in relation to the shield plane for the coupling of accessories such as: gun sights, flashlight and laser aims. The coupling is fixedly mounted on the front face of the shield, on the lower portion of the shield's pass-through aperture.

6 Claims, 4 Drawing Sheets

PROTECTION SHIELD FOR HANDGUNS

The present invention refers to a protection shield intended to protect the hands and face of handgun operators. The protection shield being mounted on firearms, paintball markers or airsoft guns.

BACKGROUND

Not only in competitions but also in real combats with firearms, tactical shields are employed for the protection of the operators. In this sense, tactical shields can work as an additional element within the safety strategies in competitions like airsoft and paintball, as well as to offer personal protection to the safety officers in their interventions or to ordinary persons defending themselves.

Conventional tactical shields, despite the above-mentioned advantages, do present a major drawback when it comes to their size, weight and handling, since at least one of the operator's hands must be holding the tactical shield so that it can offer a desirable level of protection. Another drawback being that the operator cannot fire the shots from behind the tactical shield, he will have to expose his hands.

Aiming to solve said problems, some mounted assembly types of protection have already been disclosed in the state of the art.

Document US2018017360 teaches a protective shield device with one or more holes including covers through which a user may use a weapon such as, but not limited to a pistol, rifle, stun gun, etc. The device may enable law enforcement or military personnel to discharge a weapon through a hole while remaining completely behind the protective shield. In this solution, the protection shield and gun do not have any type of mechanical connection. Therefore, the operator will have to hold the tactical shield with one of his hands and handle the gun with the other hand, by which he will have his actions limited by the equipment. Further, said tactical shield is directed to offer an ample protection of the operator's body, which results in loss of lightness and dexterity in the combat. Documents US20060230916, CN206919753 e KR2019990036446 teach similar solutions where a shield presents an opening or aperture through which the operator can fire his gun.

Document U.S. Pat. No. 8,511,215 teaches a personal protection shield for use with a weapon, such as a firearm, it may be used to protect the operator of the weapon. The shield includes one or more ballistic plates and one or more mounting assemblies to mount and to articulate a ballistic plate to the weapon. However, said shield only protects the sides of guns, and it is not adaptable for being mounted on smaller guns such as pistols and revolvers.

Document CN204064115 teaches a bulletproof cover that mainly comprises a convex plate and a fixed base. The fixed base comprises a main fixed base and an auxiliary fixed base; the fixed base consists of a fixed part and two insertion rods. When shooting is carried out against enemies, the convex plate is installed on the main fixed base; the convex plate is installed on the auxiliary fixed base in marching. This shield will only protect the upper portion of the gun and hinders the coupling of a gun sight, flashlight and other accessories. Besides that, the coupling of the main fixed base to the gun is done by means of mechanical pressure generated from a screw, which can unscrew when the gun is being used. On the other hand, documents CN203758372, US20070295199, US20110056366 and JP2004294046 teach shields that are directly connected to a weapon, preferably a rifle, which can unable the coupling of other accessories to these rifles.

The above cited prior art references indicate that the need to protect the operator, especially in combat conditions, but also during training, fun games or in sports competition, still calls for a better solution. In order for a protection shield to be really effective, it must combine such features as lightness, it must not hinder handling of the weapon as well as it should not restrain or impede the coupling of additional accessories to the weapon.

Therefore, it is an objective of the present invention to provide a solution to the above-mentioned drawbacks by means of a shield that can be coupled to various types of weapons, which enables the operator to fire shots, when necessary, while under the protection of the shield.

It is another objective of the present invention to provide a transparent shield that enables the operator to have a wide view of what is happening all around him so that he can strategically aim at targets and make decisions.

It is a further objective of the present invention to provide a shield that is resistant to several kinds of projectiles thereby offering safety to the operator.

It is still another objective of the present invention to provide a shield to which accessories such as guns sights, flashlights, lasers aims and others can be coupled.

SUMMARY

In one embodiment of the disclosure, the invention comprises a transparent or translucid shield made of ballistic proof material or not. In the center of said shield, it is provided a pass-through aperture of a big enough size so that it can be transpierced by a portion of the gun frame. On the front face of the shield, it is provided a coupling, the coupling comprising a block having on its upper portion a groove for the gun's rail of the Picatinny type and having on its lower portion a rail shape projection for coupling accessories such as guns sights, flashlights, lasers aims and others.

BRIEF DESCRIPTION OF THE DRAWINGS

The present invention will be better understood from the detailed description of one embodiment that is based on the accompanying figures, which are meant for illustration purposes and should not limit the invention in any way, where.

DESCRIPTION OF A PREFERRED EMBODIMENT

Figure 1:
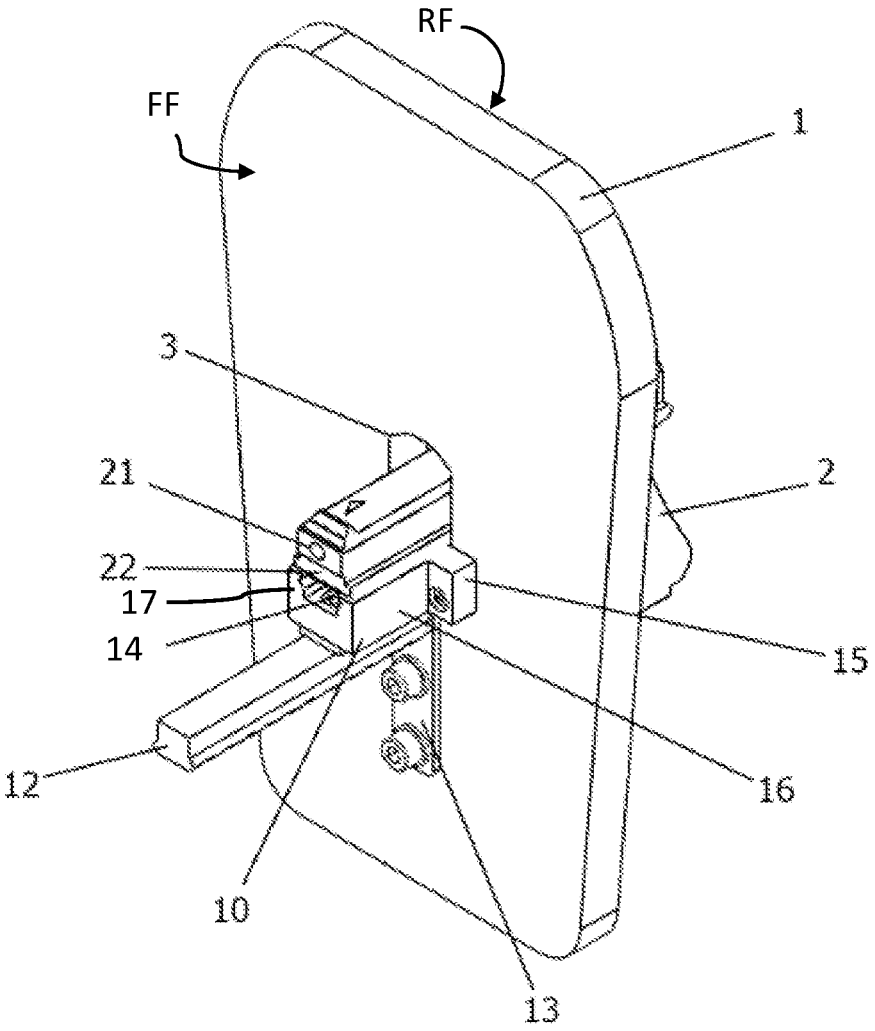
FIG. 1 is a perspective front view of the invention's protection shield coupled to a handgun.
Figure 2:
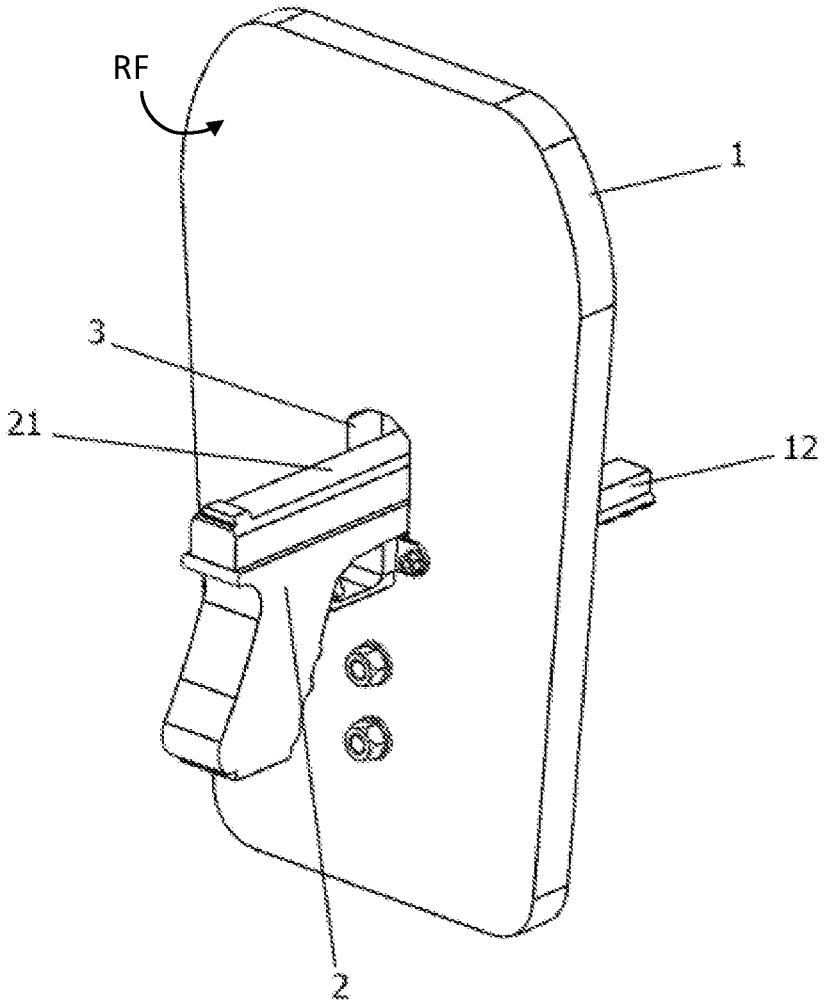
FIG. 2 is a perspective rear view of the invention's protection shield coupled to a handgun.
Figure 3:
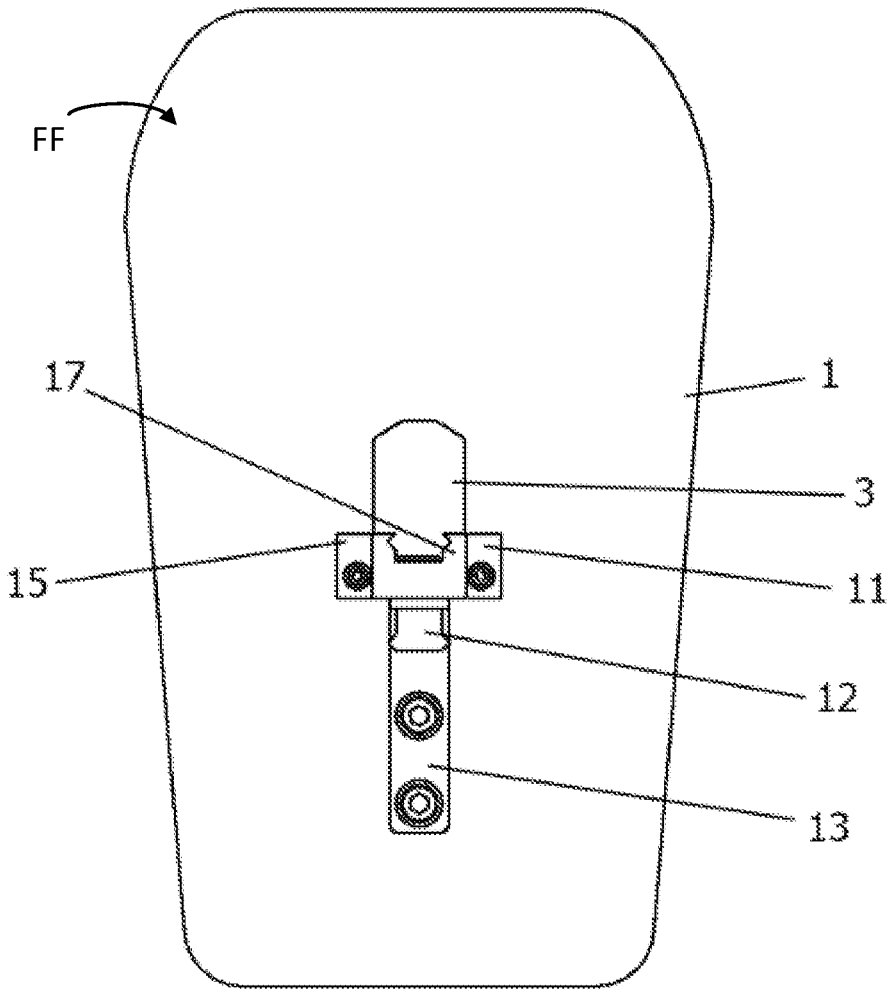
FIG. 3 is a front view of the protection shield.
Figure 4:
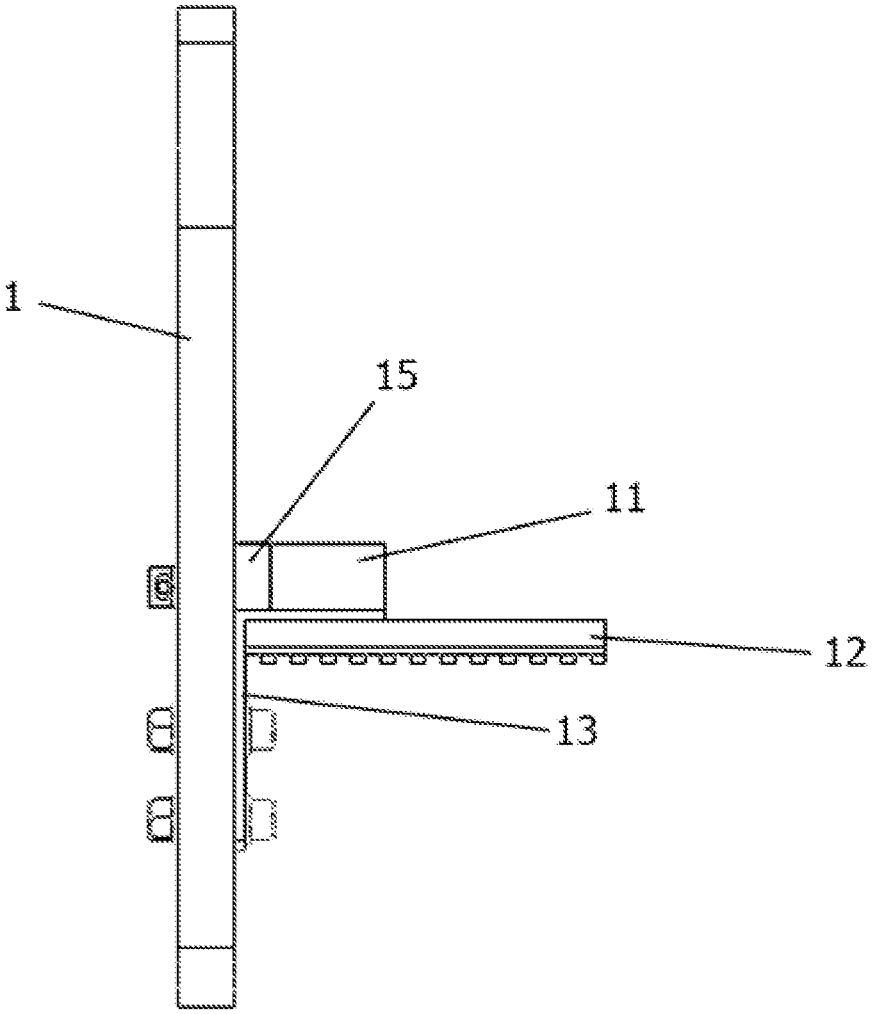
FIG. 4 is a side view of the protection shield.

The present invention refers to a protection shield that is, in its whole, indicated by the number 1 in the ensuing figures. In particular, the shield 1 is a tactical shield and it is intended to protect the area around the handgun 2 and, more specifically, the operator's hands and face.

The gun 2 can be a firearm, such as a pistol, a submachine gun, an assault rifle, a precision rifle or the like, provided that they have a coupling rail for accessories and, in particular, a Picatinny standard or type of rail. Likewise, the gun 2 may be used for sport games, such as a paintball marker or an airsoft gun.

In accordance with the present invention, the shield 1 is a transparent or translucid shield, preferably made of ballistic material. Considering the shield's thickness is directly related to its protection capacity, in the embodiments where they are to be mounted on paintball markers or airsoft guns, the shield 1 can be of a lesser thickness in comparison to the thickness desired for firearms. The materials used for manufacturing the shield 1 can also vary, provided that that the relation material/thickness ensures the necessary protection to the operator of the handgun 2.

In an embodiment of the present invention, the shield 1 comprises a pass-through aperture 3 in an approximately central position in relation to the shield's perimeter. The dimensions of the pass-through aperture must be calculated in a way to allow a free transpiercing, i.e., without mechanical obstacles, of both a portion of the gun's 2 frame and barrel 21 and of the rail 22, provided under the frame and barrel 21, as it is known in the art.

As per its dimensions, the shield 1 should have a size that is compatible and enough to protect not only the hands but also the face of the operator. In a preferred embodiment, the shield 1 has between 20 and 25 cm in width and 30 to 35 cm in height.

On the front face of the shield 1, it is provided a coupling 10 intended to attach the handgun 2 to the shield 1. The coupling 10 comprises a block 11, a rail 12 and a support 13. In an embodiment of the present invention, the coupling 10 is formed by individual parts, namely, a block 11, a rail 12 and a support 13. In this case, the block 11, the rail 12 and the support 13 can be united by means of screws 14 (see FIG. 1), or they can be welded, glued or joined together any other way, in accordance with the material they are made of. In another embodiment of the invention, the coupling 10 can be presented in the shape of a monolithic structure, for example, injected from a proper plastic material.

As illustrated in FIGS. 1 to 4, the coupling 10 comprises a parallelepiped-shaped block 11 having flaps 15 projected sideways on which orifices 16 are formed in order to provide fastening of the coupling 10 on the shield 1. The two orifices 16 of the block 11 are provided in a horizontal direction in relation to the position of use of the gun 2. Besides that, on the upper portion of the block 11 it is engraved a sliding groove 17 suitable for engaging the rail 22 provided under the barrel 21 of the handgun 2. This way, the coupling 10 is fixedly mounted on the front face of the shield 1, in the lower portion of the pass-through aperture 3 of the shield 1. In particular, the fastening position of the coupling 10 in relation to the front face of the pass-through aperture 3 is such that it allows for the handgun 2 to transpierce the pass-through aperture 3 all the way through the rear face (RF) to the front face (FF) of the shield 1, and allows that the rail 22 of the barrel 21 be inserted inside the sliding groove 17.

As mentioned, the sliding groove 17 presents a conformation according to the Picatinny standard for rails for firearms accessories. Nonetheless, the sliding groove can take on other engaging standards to suit other needs and particularities.

As illustrated, the coupling 10 further comprises an L shaped support 13 whose top portion extends through the entire, or nearly, lower face of the block 11 and whose body portion extends along the shield's 1 front face. The body portion of the L shaped support 13 that extends along the shield's 1 front face comprises at least two orifices (not visible) that are intended for fastening the coupling 10 to the shield 1 in a vertical direction, or in any crosswise direction in relation to the direction defined by the orifices 16. In this sense, the fastening of the coupling 10 to the shield 1 is accomplished in two relative cross directions, thereby distributing the tensions over the shield's 1 surface.

At last, the coupling 10 also comprises a rail 12 that is fixed under the L shaped support 13 and, therefore, having a longitudinal axis (not illustrated) parallel to the longitudinal axis of the block 11 and crosswise to the shield's 1 plane. The fastening of the rail 12 can be done by means of screws, or alternatively, by using glue, or welding of the parts that define the coupling 10.

From a functional point of view, the rail 12 projects out from the block 11 in a way to allow the engaging of accessories in the assembly defined by the shield 1 and handgun 2. As will become apparent to the person having ordinary skills in the art, the presence of the rail 12 of the coupling 10 compensates for the unavailability of the rail 21 of the handgun 2, which is in this embodiment used entirely to receive and support the shield 1. The rail 12, as illustrated, is also a Picatinny standard rail, which enables the attaching and the coupling of an array of accessories readily available in the staple market; among such accessories are: the gun sight and flashlights, laser aims and others.

In an embodiment of the invention, the block 11 can be conformed in a standard different from the Picatinny type.

Despite the fact that the object of the invention has been described and illustrated in relation to a handgun 2, it should be clear that the same concepts and construction are equally applicable to other types of guns such as pistols, revolvers, and bigger guns like rifles, submachine guns, shotguns and the like. Besides that, the shield 1 according to the present invention can be equally employed to protect similar devices, such as a paintball marker, an airsoft gun, a crossbow gun, and any other type of similar devices provided that they contain a Picatinny standard rail.

In sum, besides offering protection to the operator, in particular to his/her face and hands—areas that are usually not protected by bullet-proof vests-, the shield of the present invention further enables the coupling of accessories, which enhances its functionality without increasing mechanical complexity and total weight of the shield.

Having described some preferred examples of embodiments of the present invention, it must be understood that the present invention's scope embraces other possible variations of the inventive concept herein described, being limited only the by the ensuing claims, also including therein eventual equivalents.

What is claimed is:

1. A protection shield for handguns comprising:

a one piece transparent or translucid shield made of ballistic material or non-ballistic material comprising in the center of the shield a pass-through aperture of a big enough size so that it can be transpierced by the barrel and a portion of the gun's frame, and having a front face oriented away from a user and a back face facing the user;

wherein the shield also comprises a handgun coupling, the coupling comprising a block having on its upper portion a groove for receiving a gun rail and on its lower portion a rail projecting crosswise in relation to the shield's plane for the coupling of accessories; and wherein the coupling is fixedly mounted on the front face of the shield and sits in a lower portion of the shield's pass-through aperture.

2. The protection shield of claim 1, wherein the coupling also comprises an L shape support with a top portion extending between the block and the rail, and with a body portion extending vertically along the shield's front face, and wherein the body portion of the L shape support has at least one orifice for fastening the coupling to the shield.

3. The protection shield of claim 2, wherein the block has flaps projected sideways, being that on said flaps orifices are provided for fastening the coupling to the shield, and wherein said orifices are provided in a horizontal direction.

4. The protection shield of claim 1, wherein on the top portion of the block there is a sliding groove for receiving the gun's barrel rail.

5. The protection shield of claim 1, wherein the block has dual flaps projecting in opposite directions which are each fastened to the shield and the coupling comprises an L shape support with a top portion extending between the block and the rail and a body portion fastened to the shield, wherein body portion defines a direction that is crosswise in relation to the direction defined by the flaps of the block.

6. The protection shield of claim 1, wherein the accessories are selected from the group consisting of gun sights, flashlight, laser aims, and combination thereof.

* * * * *